United States Patent [19]

Turman

[11] 4,103,945

[45] Aug. 1, 1978

[54] EMERGENCY OPENING LATCH ACTUATOR FOR SLIDING DOOR

[76] Inventor: Thomas Bray Turman, 1280 Clarendon St., El Cajon, Calif. 92021

[21] Appl. No.: 848,268

[22] Filed: Nov. 3, 1977

[51] Int. Cl.[2] ..... E05C 19/10; E05B 3/00; E05B 65/10

[52] U.S. Cl. ..... 292/100; 49/141; 49/449; 292/DIG. 46; 292/336.3

[58] Field of Search ..... 49/449, 141; 292/336.3 X, 100, 200, DIG. 46

[56] References Cited

U.S. PATENT DOCUMENTS

| | | | |
|---|---|---|---|
| 2,861,660 | 11/1958 | Ensign | 292/DIG. 46 |
| 3,161,923 | 12/1964 | Crain | 49/449 X |
| 3,213,652 | 10/1965 | Tucker | 292/DIG. 46 |
| 3,884,514 | 5/1975 | Praska | 292/DIG. 46 |
| 3,893,261 | 7/1975 | Cribben | 49/449 |
| 4,068,874 | 1/1978 | Fleming et al. | 292/DIG. 46 |

*Primary Examiner*—Philip C. Kannan
*Attorney, Agent, or Firm*—Brown & Martin

[57] ABSTRACT

A sliding door with a lever operated latch incorporated in the handle is provided with an emergency opening mechanism for releasing the latch by merely pulling the handle. A portion of the handle is pivoted to hinge by squeezing or pulling action on the handle, and is connected to a conventional latch and lock mechanism by a simple adapter element, so that the latch lever need not be separately operated to open the door in an emergency. The mechanism is accessible only from the inside and external security is maintained.

9 Claims, 6 Drawing Figures

EMERGENCY OPENING LATCH ACTUATOR FOR SLIDING DOOR

BACKGROUND OF THE INVENTION

Exterior type sliding doors are usually provided with some type of latch, operable from the inside, to restrict entry form outside. The latch is usually actuated by a lever and mounted on the door frame, in or adjacent the door operating handle. In some types a key operated lock is used to actuate the latch from outside.

A sliding door offers rapid unobstructed passage if it can be opened readily. However, in an emergency, such as a fire, people in near panic can fumble with the small latch lever while attempting to pull the door open, which often causes the latch to bind. This is particularly true with small children or elderly people, who do not have the strength to operate the latch if it is not completely free. It would be advantageous to have a sliding door actuating device which would operate as easily as the well known panic bar used on swinging doors.

SUMMARY OF THE INVENTION

The emergency opening mechanism described herein facilitates rapid opening of a latched sliding door, without requiring direct operation of the latch. The usual vertically elongated handle attached to the door frame is replaced by a handle having a hinged portion, which is actuated by a squeezing or pulling action in the direction of door opening. The special handle is adaptable to existing latch and lock mechanisms and is coupled to the latch by a small and simple adapter.

In most sliding door latches the mechanism includes a rotatatable element, which can be turned by a key through an outside lock, or by the internal lever. The rotatable element is coupled to a hook which swings into a slot in the door jamb and hooks behind the wall of the jamb with a secure locking action. The adapter is attached to the rotatable element and is engaged by a tongue on the movable handle portion to rotate the latch mechanism.

Normal opening and closing operation of the latch is unaffected but, in an emergency, the conventional action of pulling the door open automatically releases the latch. The hinged handle is generally similar in configuration to existing types of handles and does not detract from the appearance of the door.

The primary object of this invention, therefore, is to provide a new and improved emergency opening latch actuator for a sliding door.

Another object of this invention is to provide an emergency opening latch actuator which is released by the normal door opening pull on the door handle.

Another object of this invention is to provide an emergency opening latch actuator which does not interfere with normal operation or security of the sliding door.

A further object of this invention is to provide an emergency opening latch actuator which is adaptable to many existing types of sliding door latch mechanisms.

Other objects and advantages will be apparent in the following detailed description, taken in conjunction with the accompanying drawing, in which.

DESCRIPTION OF THE PREFERRED EMBODIMENT

Figure 1:
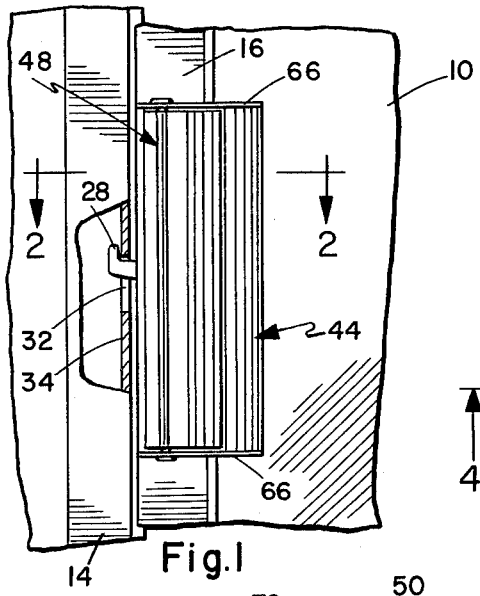
FIG. 1 is a side elevation view of the latch actuator on a sliding door.
Figure 2:
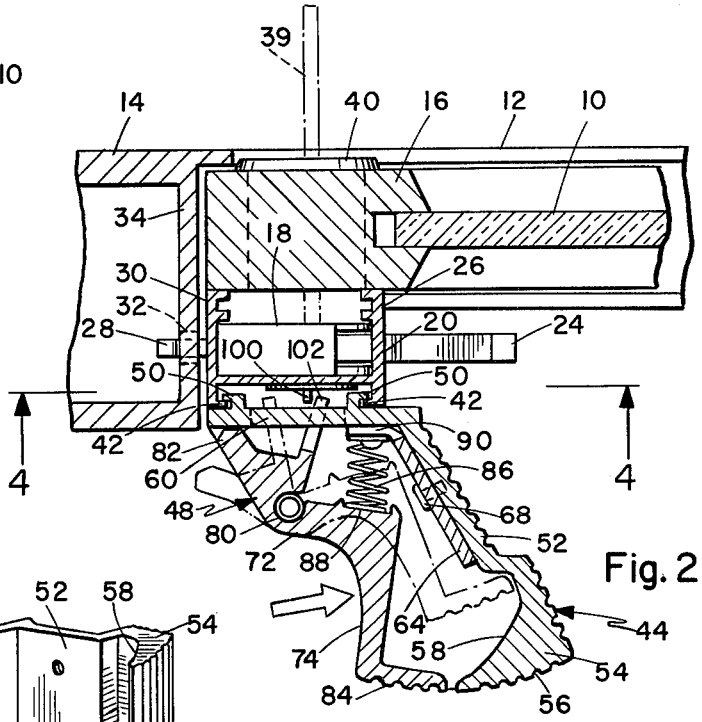
FIG. 2 is an enlarged sectional view taken on line 2—2 of FIG. 1.

The latch actuating mechanism is adapted to a convention sliding door structure, as illustrated in FIGS. 1 and 2. A sliding door 10 rides in a tract 12 and closes against a fixed jamb 14, the door having a vertical end frame member 16 on which the latch mechanism is mounted. Various types of latches are used, but most are contained in a box or housing secured to the inside face of the frame member.

In the arrangement shown the latch unit 18 is contained in a vertically elongated box channel or housing 20, which is secured to frame member 16 by screws 22. The latch unit 18 is conventional and has an actuating lever 24 extending through the side 26 of housing 20 away from the jamb. A latch hook 28 extends from the other side 30 of housing 20, to enter a slot 32 in the jamb 14 and hook behind the wall 34 of the jamb. As shown in the full line position in FIG. 4, the hook 28 is engaged or locked when lever 24 is in the up position. When lever 24 is depressed to the position shown in broken line, the hook 28 retracts into the latch unit to unlock the door. The lever 24 is attached to a cylindrical actuator hub 36 which is rotatable in the latch unit, the lever being connected to hook 28 by a toggle or over center linkage, not shown, for positive locking action. Hub 36 has an axially extending key slot 38 to facilitate operation by means of a key 39 through a lock mechanism 40 inset in frame member 16. Normally a fixed handle is secured to the housing 20 by engagement under inwardly turned flanges 42 along the inside edges of sides 26 and 30. The handle is removed for installation of the emergency latch actuator.

All the structure so far described is conventional.

Figure 3:
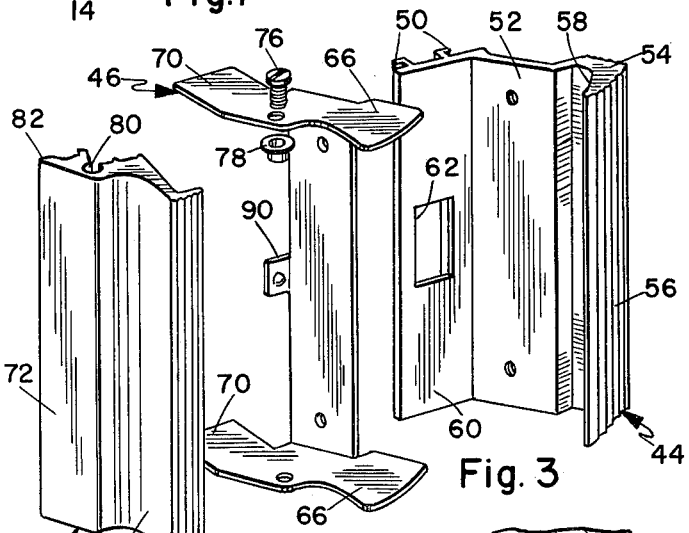
FIG. 3 is an exploded perspective view of the handle and actuator components.

The emergency operating mechanism is incorporated in a handle assembly which replaces the conventional handle. As shown in FIG. 3, the handle 44, a support frame 46 and a movable handle portion or grip 48. Fixed handle 44 has outwardly turned flanges 50 which engage the flanges 42 on housing 20, as the fixed handle is slid longitudinally into the housing. The fixed handle has a back plate 52 inclined away from jamb 14, with a thickened end rail 54, both of which may have external logitudinal grooves 56 for a good gripping surface. The inside of end rail 54 has an undercut channel 58. For simplicity of manufacture the fixed handle 44 and also grip 48, may be extruded, the respective cross sections being shown in FIG. 2. The mounting plate portion 60 of fixed handle 44, which carries the flanges 50, has a generally central opening 62 to expose the latch mechanism 18 in the area of hub 36.

Support frame 46 has an elongated mounting plate 64 with end plates 66 perpendicular thereto at opposite ends. The mounting plate 64 is secured against the inner face of back plate 52 by screws 68, or the like. End plates 66 have extensions 70 which extend over opposite ends of housing 20 and hold the fixed handle logitudinally in place.

Grip 48 has an elongated body 72 with a longitudinal concave finger channel 74. The grip is pivotally mounted in support frame 46 by screws 76 threaded through end plates 66 and into bushings 78, which are seated in opposite ends of a bore 80 extending longitudinally through the grip. Body 72 has a stop flange 82 along one edge which bears against mounting plate 60 in the rest position of the grip. The other edge of the body has a cover flange 84, which aligns with and forms an extension of the end rail 54. The basic handle is thus a two piece structure with one piece pivoted in the other, the two pieces forming a complete hand grip.

Grip 48 is biased to the rest position by a spring 86 fitted between a retaining socket 88 on the inside of the grip and lug 90 projecting from mounting plate 64. When the grip is squeezed by pressure of fingers in finger channel 74, the grip pivots on screws 76 and the cover flange is depressed into undercut 58, as in the broken line open position in FIG. 2. The end plates 66 are shaped to conform to the cross sectional configuration of the fixed handle and grip in the rest position, so as to enclose the ends of the handle assembly.

Figure 4:
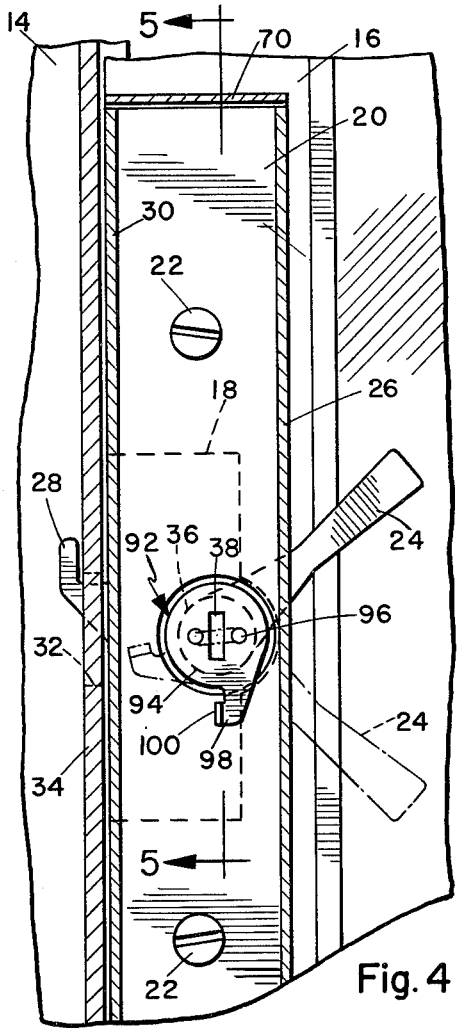
FIG. 4 is a sectional view taken on line 4—4 of FIG. 2.
Figure 6:
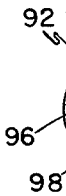
FIG. 6 is a perspective view of the actuator to latch adapter.

The latch is coupled to the handle by an adapter 92, illustrated in FIG. 6. The adapter comprises a disc 94 having a pair of pins 96 projecting from one side, the disc being attached by suitable means, such as adhesive, to one end of hub 36. Pins 96 seat in matching sockets in the hub 36 to key the adapter to the hub. Extending substantially radially from disc 94 is an arm 98 with an axially projecting lug 100 at the outer end. As shown in FIG. 4, the arm 98 extends downwardly when the latch is in locked position.

Figure 5:
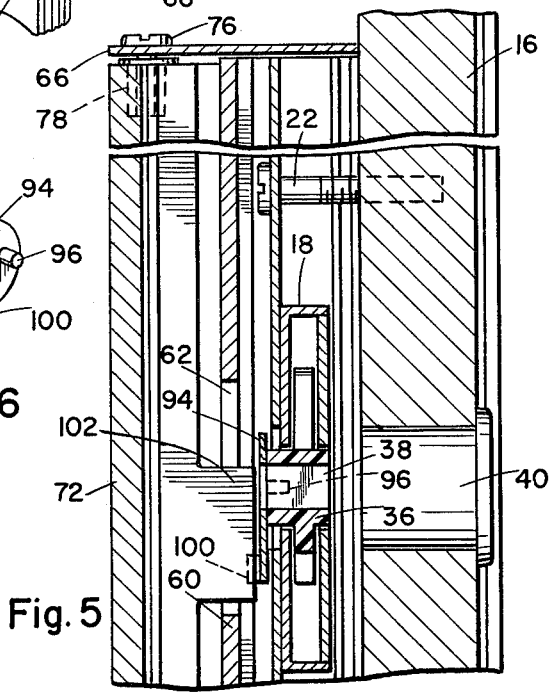
FIG. 5 is a sectional view taken on line 5—5 of FIG. 4.

Grip 48 has a tongue 102 which passes through opening 62 and overlaps lug 100, as in FIGS. 2 and 5. In the rest position of grip 48, the tongue 102 is just in contact with lug 100. When grip 48 is squeezed into the open position, the tongue 102 forces lug 100 toward wall 30, to the broken line position in FIG. 4, which rotates hub 36 and unlocks the latch.

The exact configuration of the adapter may vary to suit the particular latch mechanism, the essential feature being a lug or other projecting portion which can be engaged by the movable grip to actuate the latch. Also the specific cross sections of the handle components may vary to suit a particular installation.

The door is locked in the normal manner by actuating lever 24, and is secure from entry except by key. In the event of an emergency the door is simply pulled open in the usual manner by means of the handle. The pressure on the handle pivots grip 48 and releases the latch, without the operator having to locate and operate the small latch lever.

Having described my invention, I claim:

1. In combination with a sliding door structure including a fixed jamb, a sliding door having a frame member to seat against the jamb, a latch unit mounted on the frame member and having a latch element selectively engageable with the jamb to lock the door, an actuator coupled to said latch element and having an extended operating lever for moving the latch element between locked and unlocked positions, and a housing enclosing said latch unit, the improvement comprising:

a handle mounted on said housing;

said handle having a grip portion for gripping by a hand to open the door, the grip portion being pivotally mounted to move between a rest position and an open position;

and an adapter coupled between said actuator and said grip portion to unlock the latch element when the grip portion moves to the open position.

2. The structure of claim 1, wherein said grip portion is biased to the rest position.

3. The structure of claim 1, wherein said adapter is keyed to said actuator and has an actuating lug projecting therefrom, said grip portion having a tongue overlapping said lug for engagement therewith.

4. The structure of claim 1, wherein said handle includes a fixed portion having means for attachment to said housing means for attachment to said housing, said grip portion being pivotally attached to said fixed portion and forming an extension thereof in the rest position, and said fixed portion having an undercut to receive said grip portion in the open position.

5. The structure of claim 4, and including a spring extending between said fixed portion and said grip portion to bias the grip portion to the rest position.

6. The structure of claim 4, and including end plates enclosing the ends of said handle, said grip portion being pivoted between said end plates.

7. The structure of claim 4, wherein said adapter is secured to said actuator, said fixed portion of the handle having an opening exposing said adapter, and said grip portion having a tongue extending through said opening for engagement with the adapter.

8. The structure of claim 7, wherein said housing and said fixed portion have longitudinally slidable interfitting flanges for holding the fixed portion on the housing, said fixed portion having end plates overlapping and enclosing the ends of the handle and housing.

9. The structure of claim 7, wherein said actuator is a rotary element, said adapter having a radial arm with a lug projecting therefrom, and said tongue overlapping and engaging said lug.

* * * * *